US008905399B2

(12) United States Patent
Murashima et al.

(10) Patent No.: US 8,905,399 B2
(45) Date of Patent: Dec. 9, 2014

(54) SHEET FEED DEVICE AND IMAGE FORMING APPARATUS INCLUDING THE SAME

(71) Applicant: KYOCERA Document Solutions Inc., Osaka (JP)

(72) Inventors: Masaki Murashima, Osaka (JP); Teruyuki Miyamoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/216,777

(22) Filed: Mar. 17, 2014

(65) Prior Publication Data

US 2014/0284872 A1 Sep. 25, 2014

(30) Foreign Application Priority Data

Mar. 19, 2013 (JP) ..... 2013-056367

(51) Int. Cl.
*B65H 1/04* (2006.01)
*B65H 3/06* (2006.01)
*B65H 1/14* (2006.01)

(52) U.S. Cl.
CPC ..... *B65H 3/0684* (2013.01); *B65H 1/04* (2013.01); *B65H 1/14* (2013.01)
USPC ..... 271/164; 271/167

(58) Field of Classification Search
CPC ..... B65H 1/04; B65H 2405/11; B65H 2405/321; B65H 2405/31
USPC ..... 271/162, 164, 167, 121
See application file for complete search history.

(56) References Cited

FOREIGN PATENT DOCUMENTS

JP 05032325 A 2/1993

*Primary Examiner* — Michael McCullough
(74) *Attorney, Agent, or Firm* — Alleman Hall McCoy Russell & Tuttle LLP

(57) ABSTRACT

A sheet feed device according to an aspect of the present disclosure includes an apparatus body, a cassette, a sheet conveying path, a pickup roller, a feeding portion, a lift plate, and a regulation member. Feeding portion conveys sheet fed from pickup roller downstream in sheet conveying direction while holding sheet at nip portion. Lift plate is changeable in position between first position and second position. When cassette is removed from apparatus body and lift plate is positioned in first position, regulation member protrudes to sheet conveying path on upstream side in sheet conveying direction relative to nip portion to thereby regulate entering of sheet stored in sheet storage portion into nip portion. When cassette is mounted into apparatus body and lift plate is positioned in second position, regulation member retreats from sheet conveying path thereby to cause sheet conveying path to become open.

16 Claims, 12 Drawing Sheets

SHEET FEED DEVICE AND IMAGE FORMING APPARATUS INCLUDING THE SAME

INCORPORATION BY REFERENCE

This application is based upon and claims the benefit of priority from the corresponding Japanese Patent Application No. 2013-056367 filed on Mar. 19, 2013, the entire contents of which are incorporated herein by reference.

BACKGROUND

The present disclosure relates to sheet feed devices that feed sheets, and image forming apparatuses that includes the sheet feed devices.

To date, as sheet feed devices that feed sheets, those devices which are mounted to an image forming apparatus are known. The sheet feed device includes a sheet cassette detachably mounted to the apparatus body of the image forming apparatus, a pickup roller located in the apparatus body, a sheet feed roller, and a retard roller. The sheet cassette accommodates sheets. And with rotation of the pickup roller, the sheets are fed in the sheet conveying direction.

The sheets fed by the pickup roller are conveyed into a fed-sheet nip portion which is formed with a sheet feed roller and a retard roller. With a rotation of the sheet feed roller, the sheets are further conveyed downstream in the sheet conveying direction.

An image forming apparatus known to date is structured such that a sheet conveying path extends along the sheet cassette mounting direction inside the apparatus body.

SUMMARY

A sheet feed device according to an aspect of the present disclosure includes an apparatus body, a cassette, a sheet conveying path, a pickup roller, a feeding portion, a lift plate, and a regulation member. The cassette is configured to be detachably mounted to the apparatus body along a sheet conveying direction, and has a sheet storage portion that stores therein sheets. The sheet conveying path extends from the sheet storage portion toward the apparatus body, to convey each of the sheets. The pickup roller is disposed on an inlet side of the sheet conveying path in such a manner as to oppose the sheet storage portion, and is configured to come in contact with the sheet stored in the sheet storage portion to thereby feed the sheet. The feeding portion includes a sheet feed roller and a separation roller. The sheet feed roller is disposed on a downstream side in the sheet conveying direction relative to the pickup roller. The separation roller is in contact with the sheet feed roller to thereby form a nip portion. The feeding portion conveys the sheet fed from the pickup roller downstream in the sheet conveying direction while holding the sheet at the nip portion. The lift plate is disposed in the sheet storage portion so as to allow the sheets to be placed thereon. And the lift plate is configured to be changeable in its position between a first position which is along a bottom portion of the cassette and a second position which is upper than the first position and at which an end of the sheet stored in the sheet storage portion, the end being on the downstream side in the sheet conveying direction, is caused to come in contact with the pickup roller. The regulation member is disposed in the apparatus body. The regulation member is configured, when the cassette is removed from the apparatus body and the lift plate is positioned in the first position, to protrude to the sheet conveying path on an upstream side in the sheet conveying direction relative to the fed-sheet nip portion to thereby regulate entering of the sheets stored in the sheet storage portion into the fed-sheet nip portion. The regulation member is configured, when the cassette is mounted into the apparatus body and the lift plate is positioned in the second position, to retreat from the sheet conveying path thereby to cause the sheet conveying path to become open.

An image forming apparatus according to another aspect of the present disclosure includes the above-described sheet feed device and an image forming portion. The image forming portion forms an image on a sheet conveyed by the sheet feed device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
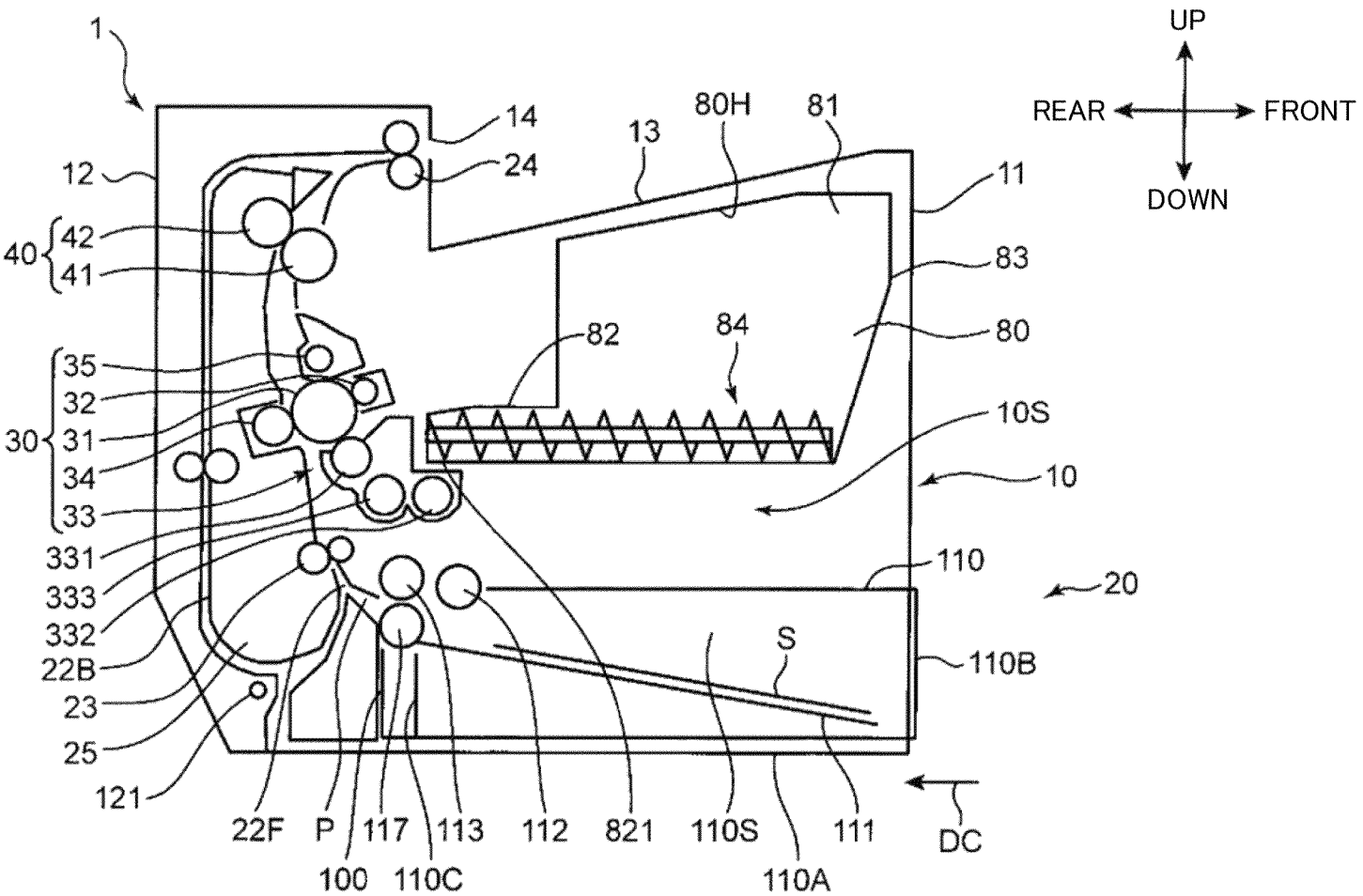
FIG. 1 is a cross-sectional view schematically showing an internal structure of an image forming apparatus according to an embodiment of the present disclosure.

Hereinafter, an embodiment of the present disclosure will be described in detail based on the drawings. FIG. 1 is a lateral cross-sectional view showing an internal structure of an image forming apparatus 1 according to an embodiment of the present disclosure. In the description herein, as the image forming apparatus 1, a black and white printer is illustrated. However, the image forming apparatus may be a copy machine, a facsimile apparatus, or a multifunction peripheral having functions of those machines and apparatuses. Further, the image forming apparatus may be of a type that forms color images.

The image forming apparatus 1 includes a main body housing 10 (apparatus body) structured as an almost rectangular parallelepiped housing, and includes in the main body housing 10, an image forming portion 30, a fixing portion 40, a toner container 80, and a sheet feed portion 20. Various devices that execute image formation are mounted in an internal space 10S of the main body housing 10 that is defined by a front cover 11, a rear cover 12, and a sheet discharge portion 13.

The image forming portion 30 performs an image forming process in which a toner image is formed on a sheet S fed by the sheet feed portion 20. The image forming portion 30 includes a photosensitive drum 31, and also includes a charging device 32, an exposure device (which is not shown in FIG. 2), a developing device 33, a transfer roller 34, and a cleaning device 35 which are disposed around the photosensitive drum 31.

The fixing portion 40 performs a fixing process in which a transferred toner image is fixed onto a sheet S. The fixing portion 40 includes a fixing roller 41 having a heat source thereinside, and a pressure roller 42 that is pressed against the fixing roller 41 to form a fixing nip portion between the pressure roller 42 and the fixing roller 41. When the sheet S with the toner image transferred thereonto passes through the fixing nip portion, the toner image is heated by the fixing roller 41 and pressurized by the pressure roller 42, to be fixed onto the sheet S.

The toner container 80 stores additional toner to be supplied to the developing device 33. The additional toner stored in the toner container 80 is supplied, by a rotating member 84 being driven to rotate, into the developing device 33 through a toner outlet 821 that is disposed at the bottom surface of an end portion of a cylindrical portion 82.

The sheet feed portion 20 includes a cassette 110 that stores sheets S on which image forming processing is to be performed. The cassette 110 has a sheet storage portion 110S in which a bundle of sheets S are stored, a lift plate 111 that is lifted for feeding the bundle of sheets S, and the like. The sheets S are conveyed from the cassette 110 into a main conveying path 22F which extends inside the main body housing 10. The main conveying path 22F and the cassette 110 will be described in detail below.

In the main body housing 10, the main conveying path 22F and a reverse conveying path 22B are provided for conveying sheets S. The main conveying path 22F extends from the sheet storage portion 110S of the sheet feed portion 20 through the image forming portion 30 and the fixing portion 40 to a sheet discharge outlet 14 that is located facing the sheet discharge portion 13 on the top surface of the main body housing 10. The reverse conveying path 22B is a conveying path through which a sheet S on which a one-side printing has been performed is returned upstream of the image forming portion 30 in the main conveying path 22F when double-side printing is performed for the sheet S.

The main conveying path 22F extends in such a manner as to pass through the transfer nip portion, formed with the photosensitive drum 31 and the transfer roller 34, from the lower side toward the upper side. Further, a pair of registration rollers 23 is disposed upstream of the transfer nip portion in the main conveying path 22F. The sheet S is temporarily stopped at the pair of registration rollers 23 to perform skew correction for the sheet S, and is thereafter fed to the transfer nip portion at a predetermined timing for image transfer. A plurality of conveying rollers for conveying sheets S are disposed at appropriate positions in the main conveying path 22F and the reverse conveying path 22B. For example, a pair of sheet discharge rollers 24 is disposed near the sheet discharge outlet 14.

<Sheet Feed Portion>

Figure 2:
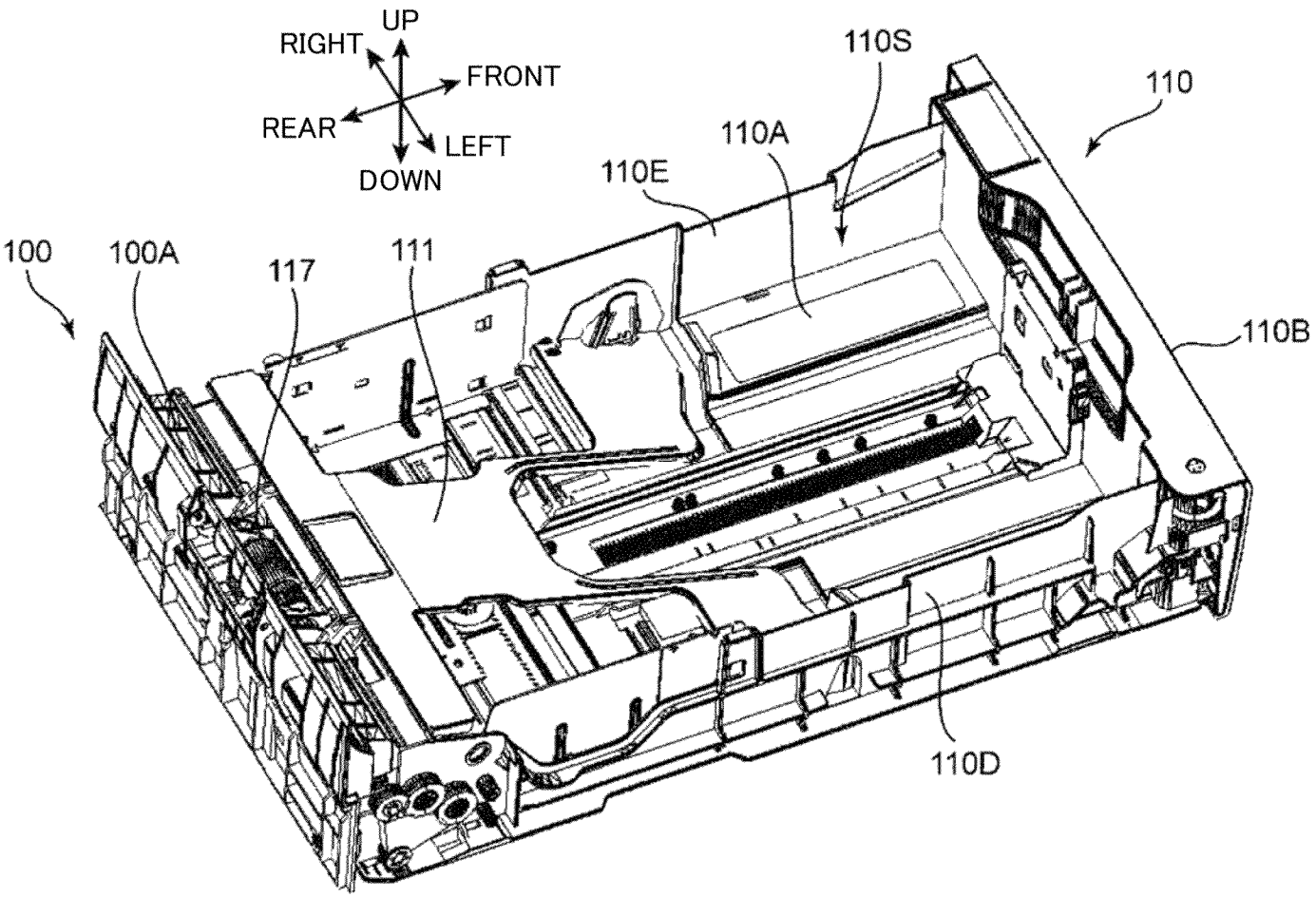
FIG. 2 is a perspective view of a part of an apparatus body of the image forming apparatus and a cassette according to the embodiment of the present disclosure.
Figure 3:
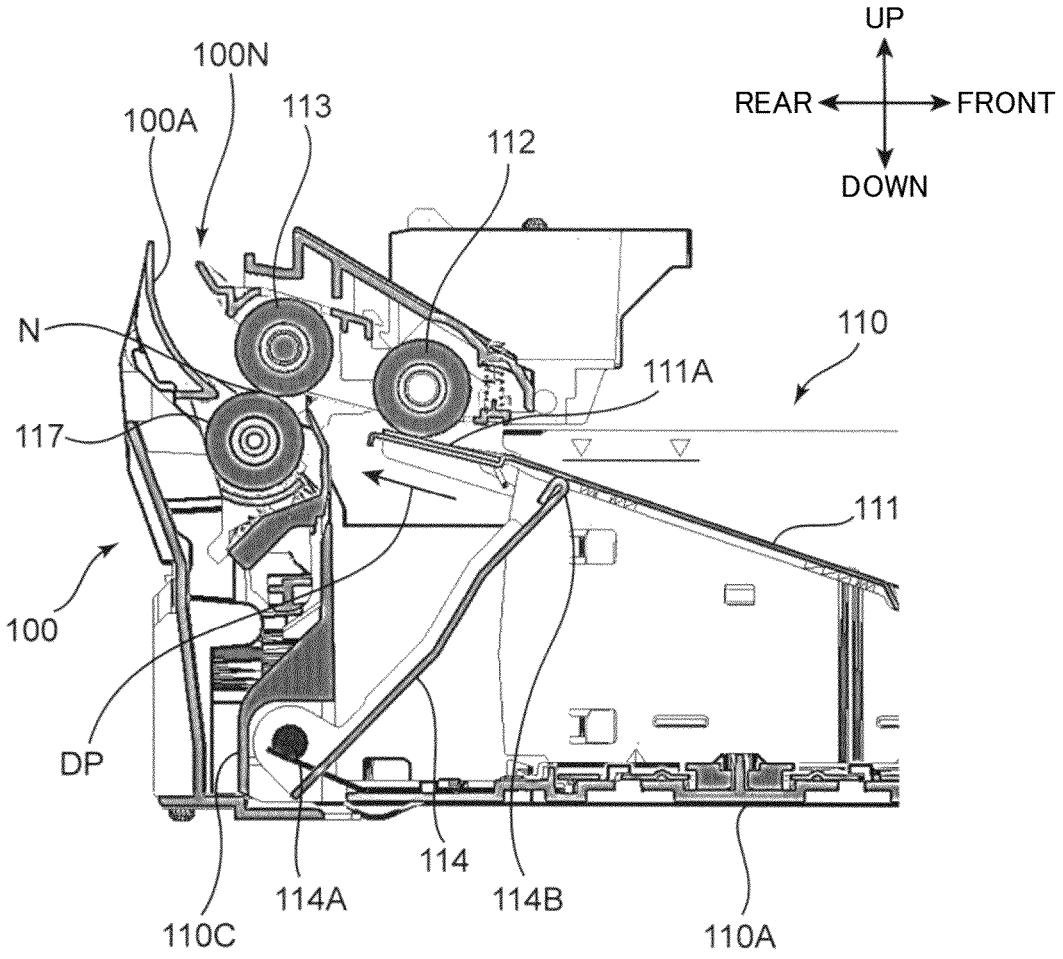
FIG. 3 is an enlarged cross-sectional view of a fed-sheet nip portion and its surrounding area according to the embodiment of the present disclosure.
Figure 4:
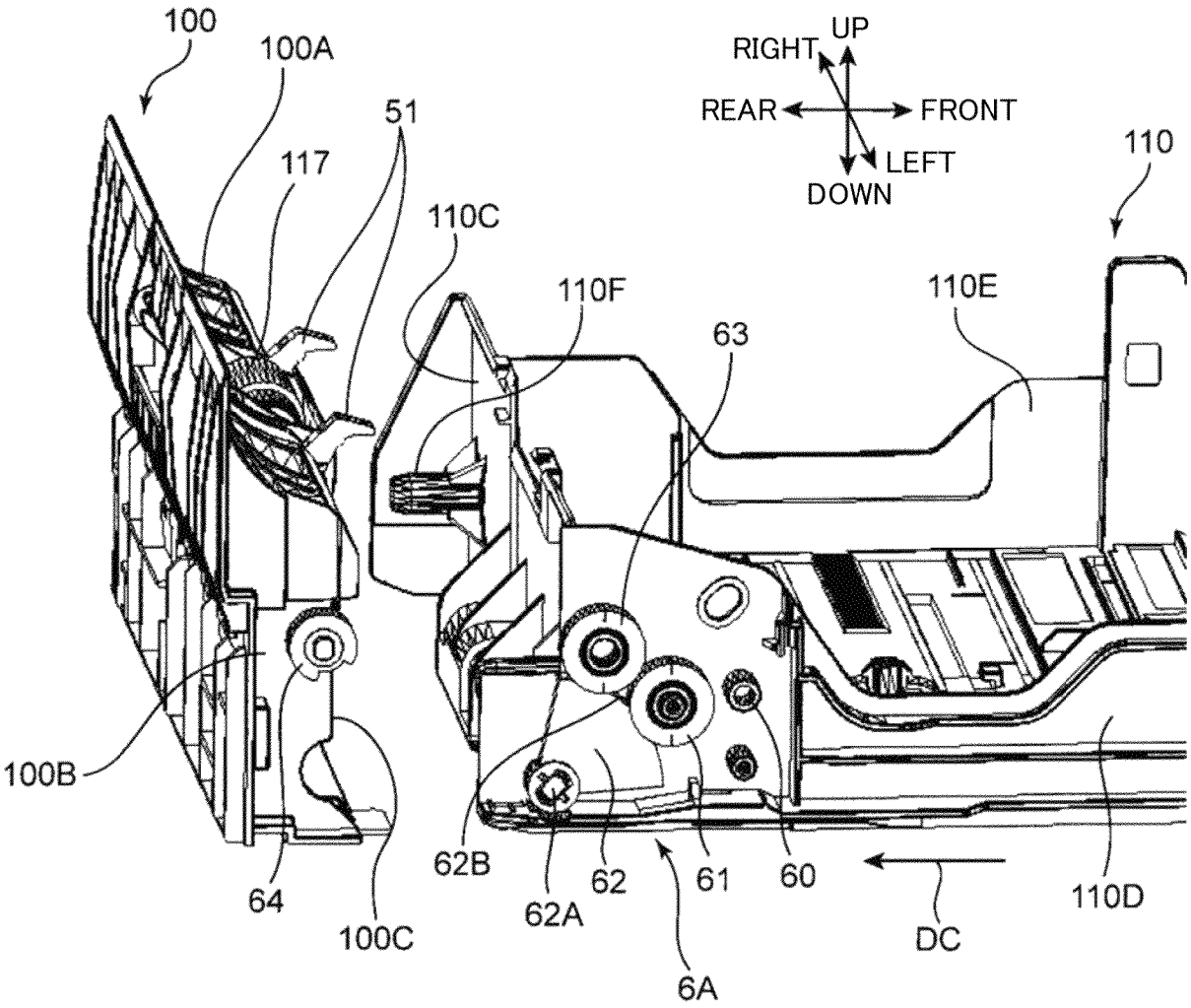
FIG. 4 is a perspective view showing a part of the apparatus body of the image forming apparatus and a part of the cassette according to the embodiment of the present disclosure.
Figure 5:
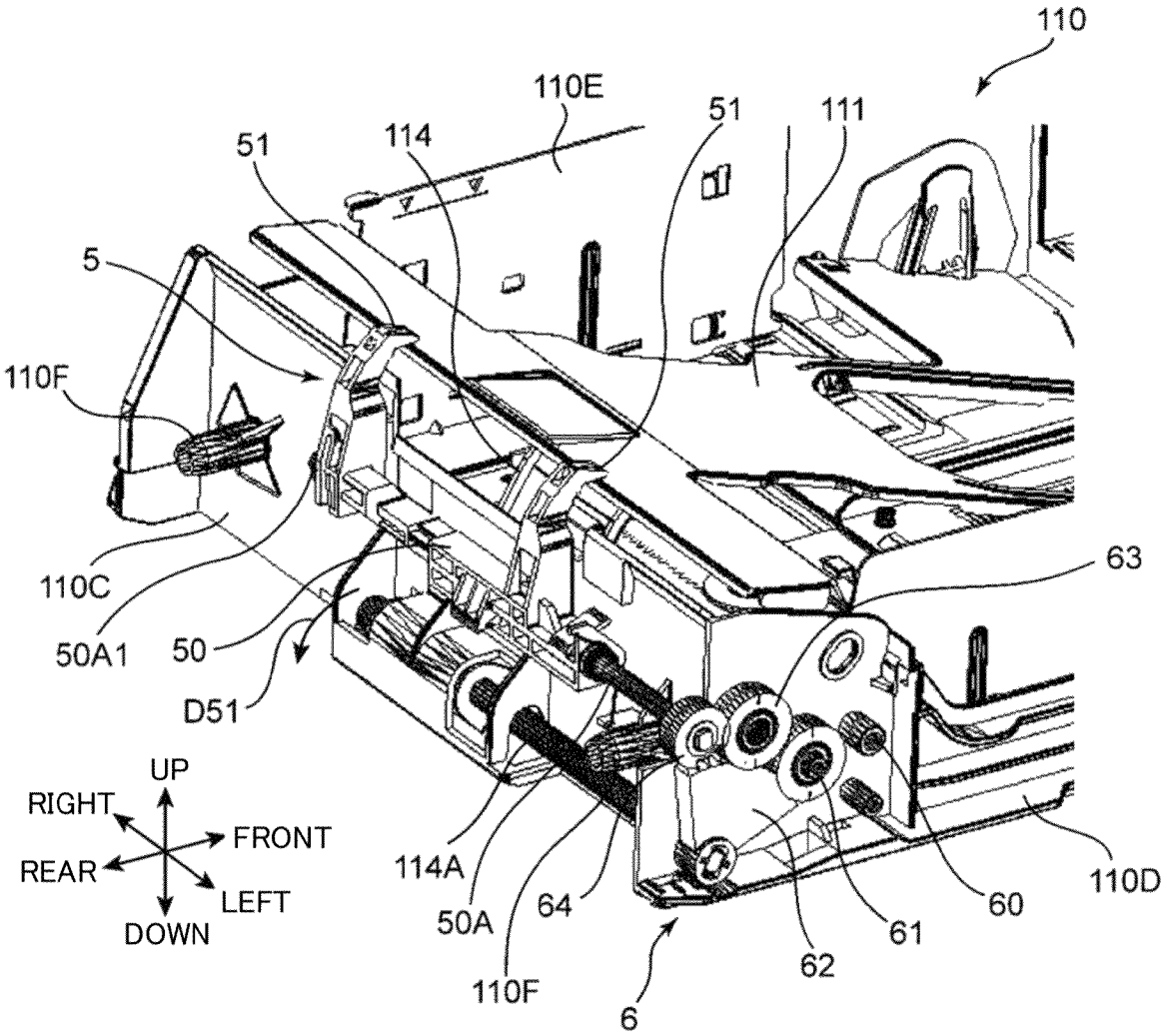
FIG. 5 is a perspective view showing a part of the apparatus body of the image forming apparatus and a part of the cassette according to the embodiment of the present disclosure.

Next, the sheet feed portion 20 (sheet feed device) according to this embodiment will be described in detail with reference to FIGS. 2 to 5 as well as FIG. 1. The sheet feed portion 20 includes the cassette 110 and a guide wall portion 100. FIG. 2 is a perspective view of the cassette 110 and the guide wall portion 100, and FIG. 3 is a cross-sectional view showing a fed-sheet nip portion N and its surrounding area in the sheet feed portion 20. FIG. 4 is a perspective view showing a state where the cassette 110 is to be mounted to the guide wall portion 100 of the main body housing 10. Further, FIG. 5 is a perspective view showing a part of the cassette 110 and a part of the guide wall portion 100.

The cassette 110 is detachably mounted to the main body housing 10 (apparatus body). In this embodiment, the cassette 110 is mounted toward the direction (mounting direction) indicated by an arrow DC shown in FIGS. 1 and 4. The cassette 110 includes a cassette bottom wall 110A (bottom portion) and the sheet storage portion 110S. The sheet storage portion 110S accommodates therein sheets S. Sheets S accommodated in the sheet storage portion 110S are conveyed through the main conveying path 22F (sheet conveying path). The main conveying path 22F is a conveying path that extends from the sheet storage portion 110S to the main body housing 10, and sheets S are conveyed toward a sheet conveying direction (direction indicated by an arrow DP in FIG. 3) which extends along the mounting direction. The cassette 110 is of a box shape having wall portions standing up from the front, rear, left, and right edges of the cassette bottom wall 110A. In other words, the cassette 110 further includes a cassette front wall 110B, a cassette rear wall 110C (leading end wall), a cassette left wall 110D (side wall), and a cassette right wall 110E.

The cassette front wall 110B defines the front side of the cassette 110, and is flush with the front cover 11 of the main body housing 10 (see FIG. 1). The cassette rear wall 110C defines the rear side of the cassette 110. In other words, the cassette rear wall 110C is a wall portion standing at the leading end toward which the cassette 110 is inserted to thereby be mounted to the main body housing 10. Further, the cassette left wall 110D is a side wall on the left side of the cassette 110, and is disposed along the mounting direction in such a manner as to intersect the cassette rear wall 110C. The cassette right wall 110E is a side wall on the right side of the cassette 110, and is disposed parallel to the cassette left wall 110D.

The cassette 110 further includes the lift plate 111 and a lifting portion 114 (lifting member).

The lift plate 111 is disposed to the bottom side of the cassette 110. Sheets S are placed on the lift plate 111. When the lift plate 111 moves up, the sheets S in the sheet storage portion 110S are caused to move such that their ends on the downstream side in the sheet conveying direction move toward a pickup roller 112. More specifically, the position of the lift plate 111 is changeable between a first position which is along the cassette bottom wall 110A of the cassette 110 and a second position which is upper than the first position and which allows an end of each sheet S in the sheet storage portion 110S, which end is on the downstream side in the sheet conveying direction, to come in contact with the pickup roller 112 to be described below. In FIGS. 1 to 3, and FIG. 5, the lift plate 111 is in the second position. In FIG. 4, the lift plate 111 is in the first position. A lift plate contact portion 111A shown in FIG. 3 is located facing the pickup roller 112, and allows each sheet S to come in contact with the pickup roller 112. Upon the cassette 110 being mounted to the main body housing 10, the lift plate 111 is caused to move up and down by the lifting portion 114.

The lifting portion 114 is disposed between the cassette bottom wall 110A of the cassette 110 and the lift plate 111 (see FIG. 3). The lifting portion 114 includes a lifting shaft 114A (supporting shaft) and a lifting abutment 114B. Rotation of the lifting portion 114 about the lifting shaft 114A allows the lift plate 111 to move up and down. The lifting abutment 114B abuts against the underside surface of the lift plate 111. As shown in FIG. 5, the lifting shaft 114A is disposed at a lower end of the cassette rear wall 110C of the cassette 110, and extends from the center, in the left-right direction, of the cassette rear wall 110C to the left side of the cassette left wall 110D penetrating the cassette left wall 110D. The left side end of the lifting shaft 114A is connected to a sector gear 62 to be described below.

The guide wall portion 100 is a unit disposed inside the main body housing 10 in such a manner as to face the cassette 110. The guide wall portion 100 includes a guide surface 100A, a side wall 100B (main-body-side wall), and a facing wall 100C. The guide surface 100A is a curved surface located at the top surface of the guide wall portion 100. The guide surface 100A guides a sheet S fed from the cassette 110 toward the pair of registration rollers 23 (see FIG. 1). The side wall 100B is a left side wall of the guide wall portion 100. The side wall 100B is disposed intersecting the facing wall 100C, and disposed along the cassette left wall 110D of the cassette 110. The facing wall 100C is a front wall of the guide wall portion 100, and disposed opposing the cassette rear wall 110C of the cassette 110. As shown in FIGS. 4 and 5, a pair of positioning members 110F protrudes from the cassette rear wall 110C of the cassette 110. The facing wall 100C of the guide wall portion 100 is provided with insertion pores (not shown) formed to face the positioning members 110F. Positioning of the cassette 110 in the main body housing 10 is performed with the positioning members 110F inserted into the insertion pores.

Further, the sheet feed portion 20 is provided with the pickup roller 112 and a feeding portion 100N.

The pickup roller 112 is disposed at an inlet side of the main conveying path 22F in such a manner as to oppose the sheet storage portion 110S (see FIG. 1). The pickup roller 112 is disposed above the rear side end (end on the downstream side in the sheet conveying direction) of the sheet storage portion 110S. The pickup roller 112 is disposed at the center in the sheet width direction (left-right direction) of the cassette 110, which sheet width direction intersects the mounting direction (rear direction) of the cassette 110. As described above, when the lift plate 111 is lifted, the sheet S comes in contact with the pickup roller 112 at the end on the downstream side in the sheet conveying direction. With a rotation of the pickup roller 112 by a driving mechanism (not shown), the sheet S are conveyed downstream in the sheet conveying direction.

The feeding portion 100N (see FIG. 3) is disposed on the downstream side of the pickup roller 112 in the sheet conveying direction. The feeding portion 100N has the fed-sheet nip portion N which holds and conveys a sheet S, and the sheet S is conveyed downstream in the sheet conveying direction. Specifically, the feeding portion 100N has a sheet feed roller 113 and a retard roller 117.

The sheet feed roller 113 is disposed on the downstream side of the pickup roller 112 in the sheet conveying direction. The sheet feed roller 113 is driven to rotate by a driving mechanism (not shown), and thereby the sheet S fed by the pickup roller 112 is held by the fed-sheet nip portion N and further conveyed downstream in the sheet conveying direction.

The retard roller 117 (opposing member) is disposed below the sheet feed roller 113 so as to oppose the sheet feed roller 113. The retard roller 117 is in contact with the sheet feed roller 113 and the fed-sheet nip portion N is formed between the retard roller 117 and the sheet feed roller 113, which allows the sheet S to be conveyed thereinto and pass therethrough. The main conveying path 22F extends from the sheet storage portion 110S of the cassette 110 in such a manner as to pass through the fed-sheet nip portion N. The retard roller 117 is driven to rotate by the sheet feed roller 113. When a plurality of sheets S enter the fed-sheet nip portion N, only one sheet S on the top is conveyed, by the sheet feed roller 113, downstream in the sheet conveying direction. The remaining sheets S abut against the circumferential surface of the retard roller 117 and thus are stopped at the fed-sheet nip portion N.

<Regulation Member>

Figure 7:
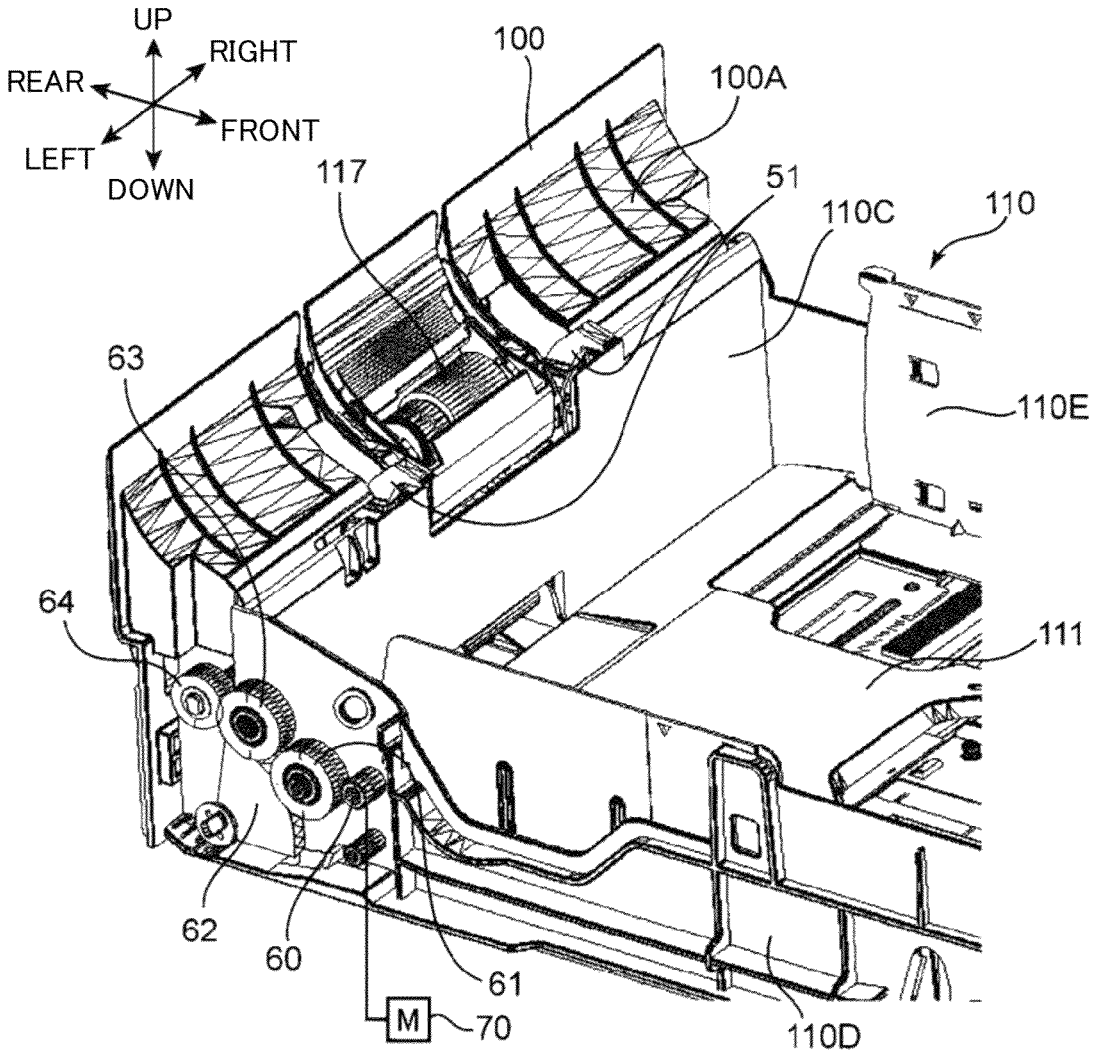
FIG. 7 is a perspective view showing a part of the apparatus body of the image forming apparatus and a part of the cassette in a state where a lift plate is lowered.

As shown in FIG. 4, when the cassette 110 is mounted to the main body housing 10 (arrow DC), the lift plate 111 is disposed in the first position along the cassette bottom wall 110A (see FIG. 7). When the sheet storage portion 110S is almost fully filled with a number of sheets S, and the cassette 110 is strongly mounted to the main body housing 10, there may be a case where a plurality of sheets S becomes likely to enter the fed-sheet nip portion N at a time. When a print operation is started on the image forming apparatus 1 under this situation, multi-feed will occur, where the plurality of sheets S are conveyed, at a time, downstream in the main conveying path 22F, resulting in paper jam.

In order to solve the above-described problem, in this embodiment, the sheet feed portion 20 is provided with a regulation member 5. With reference to FIGS. 4 and 5, the regulation member 5 is disposed on the facing wall 100C of the guide wall portion 100 in such a manner as to face the cassette 110. In FIG. 5, the guide wall portion 100 is not shown for the convenience of description, but the regulation member 5 and the cassette 110 are shown.

When the cassette 110 is removed from the main body housing 10, and the lift plate 111 is positioned in the first position, the regulation member 5 protrudes, relative to the fed-sheet nip portion N, to the upstream in the sheet conveying direction of the main conveying path 22F. As a result, the regulation member 5 regulates entering of sheets S stored in the sheet storage portion 110S into the fed-sheet nip portion N. On the other hand, when the cassette 110 is mounted into the main body housing 10, and the lift plate 111 is positioned in the second position (lifted position), the regulation member 5 moves away and retreats from the main conveying path 22F to cause the main conveying path 22F to be open. Consequently, a sheet S is allowed to be conveyed from the sheet storage portion 110S to the fed-sheet nip portion N. The regulation member 5 protrudes, relative to the fed-sheet nip portion N, to the upstream in the sheet conveying direction of the main conveying path 22F even when the lift plate 111 is positioned in the first position (lowered position) in the main body housing 10.

With reference to FIG. 5, the regulation member 5 includes a support portion 50 (axis portion), and regulation pieces 51 (regulation member). The support portion 50 is a main portion of the regulation member 5 and is of a square column shape extending in the left-right direction (sheet width direction). The support portion 50 extends along the facing wall 100C of the guide wall portion 100. The support portion 50 includes a shaft 50A. The shaft 50A is an axis member that extends from the support portion 50 to the left. To the left end of the shaft 50A, a second transmission gear 64 to be described below is fixed. The support portion 50 including the shaft 50A serves as a rotation axis for rotation of the regulation pieces 51. The regulation pieces 51 are a pair of protruding pieces protruding from the support portion 50 in the radial direction of the rotation of the support portion 50. The regulation pieces 51 rotate about the support portion 50 with the support portion 50, and thus the regulation pieces 51 are capable of protruding to and retreating from the main conveying path 22F.

Figure 6:
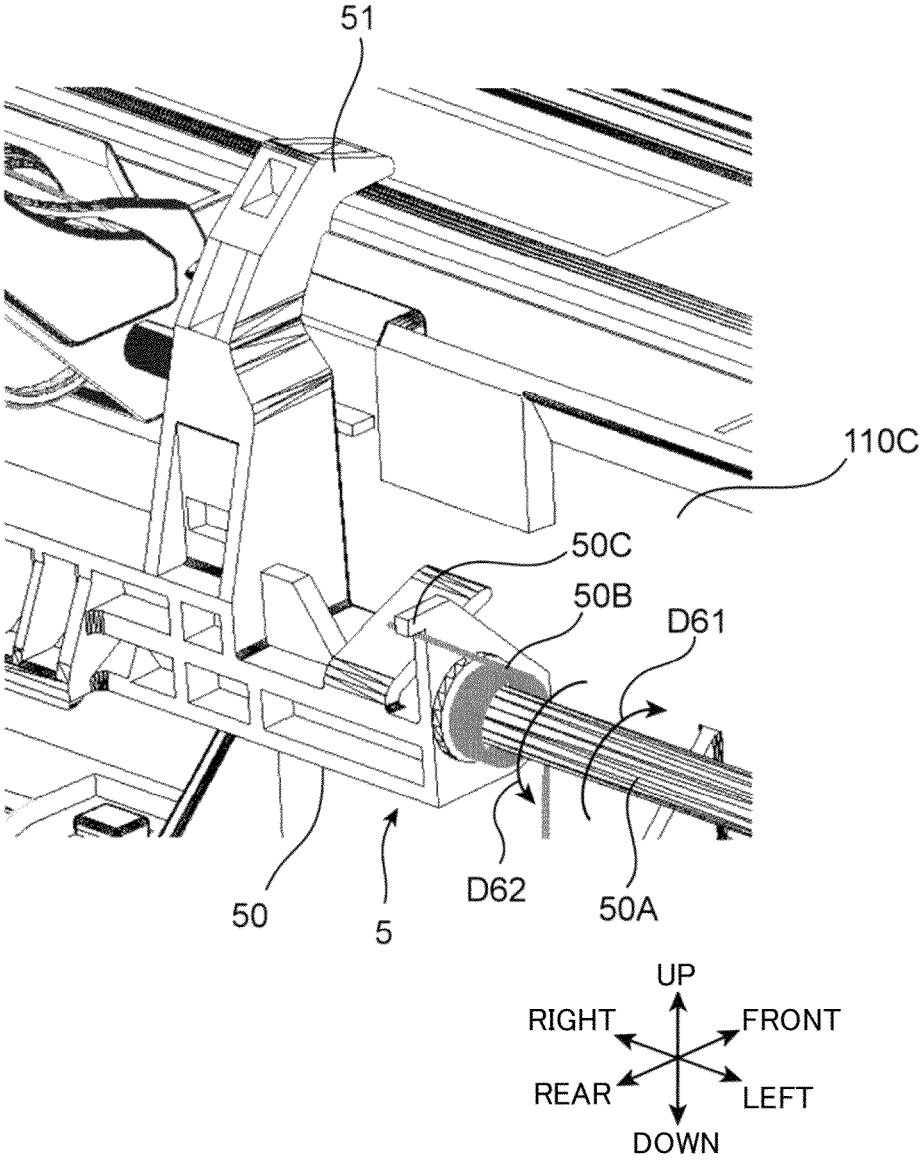
FIG. 6 is an enlarged perspective view showing a part of a regulation member according to the embodiment of the present disclosure.

FIG. 6 is an enlarged perspective view of the regulation piece 51 on the right side of the regulation member 5 and the surrounding components. The regulation member 5 further includes a spring member 50B (urging member). The spring member 50B is implemented as a coil spring. The spring member 50B is fitted onto the shaft 50A from the left end portion. An end of the spring member 50B engages with an engagement portion 50C protruding from the right end portion of the support portion 50. The spring member 50B urges the support portion 50, along a circumferential direction of a rotation of the support portion 50, toward the direction in which the regulation member 5 protrudes to the main conveying path 22F. As a result, even when driving force is not transmitted to the regulation member 5, the regulation pieces 51 of the regulation member 5 are caused to protrude to the main conveying path 22F.

<Movement of Lift Plate and Regulation Member>

Next, movement mechanism of the lift plate 111 and the regulation member 5 according to the present embodiment will be described. The sheet feed portion 20 includes a drive motor 70 (driving portion) and a transmission mechanism 6.

The drive motor 70 (see FIG. 7) is disposed in the main body housing 10. The drive motor 70 includes a reduction gear (not shown). The reduction gear engages with a main-body-side input gear (not shown) disposed rotatably about a main-body-side input axis 60 shown in FIG. 7. The rotational driving force of the drive motor 70 is transmitted from the reduction gear toward the cassette 110 via the main-body-side input gear. The drive motor 70 generates driving force for causing the lift plate 111 to move between the first position and the second position. Further, the driving force the drive motor 70 generates is converted by means of the transmission mechanism 6 into rotation of the regulation member 5. In FIG. 7, due to omission, the drive motor 70 appears to be connected to the main-body-side input axis 60. However, in fact, the reduction gear (not shown) located in the drive motor 70 engages with the main-body-side input gear (not shown) supported rotatably about the main-body-side input axis 60 as described above.

The transmission mechanism 6 causes the regulation member 5 to protrude to or retreat from the main conveying path 22F in conjunction with an up-down movement of the lift plate 111 by the drive motor 70. A part of the transmission mechanism 6 is disposed on the side wall 110D of the cassette 110, and another part of the transmission mechanism 6 is disposed on the side wall 100B of the guide wall portion 100. Upon the cassette 110 being mounted into the main body housing 10, the driving force of the drive motor 70 is transmitted to the lift plate 111 and the regulation member 5 via the transmission mechanism 6. The transmission mechanism 6 includes a transmission member 6A and a second transmission gear 64 (gear portion).

The transmission member 6A is disposed on the cassette 110 and connected to the gear of the drive motor 70 to thereby cause the lift plate 111 to rotate about the lifting shaft 114A. With reference to FIG. 4, the transmission member 6A is disposed at a leading end, in the mounting direction, of the cassette left wall 110D of the cassette 110. The transmission member 6A includes an input gear 61, a sector gear 62, and a first transmission gear 63.

The input gear 61 is connected to the main-body-side input gear (not shown) disposed in the main-body-side input axis 60. The input gear 61 is a gear that transmits the rotational driving force of the drive motor 70 to the sector gear 62.

The sector gear 62 is a fan-shaped member. The sector gear 62 includes a sector gear axis portion 62A and an outer circumferential gear portion 62B. The sector gear 62 is rotatable about the sector gear axis portion 62A. The outer circumferential gear portion 62B engages with the input gear 61 and the first transmission gear 63. Further, the sector gear axis portion 62A of the sector gear 62 is connected to the lifting shaft 114A which penetrates the cassette left wall 110D of the cassette 110. Further, the first transmission gear 63 is a gear that engages with an upper part of the sector gear 62. When the rotational driving force is transmitted from the input gear 61 to the sector gear 62, and the sector gear 62 rotates about the sector gear axis portion 62A, then the lifting portion 114 causes the lift plate 111 to move up and down. With the rotation of the sector gear 62, the first transmission gear 63 rotates.

The second transmission gear 64 is disposed in the guide wall portion 100. Specifically, the second transmission gear 64 is disposed on the left end (one end) of the shaft 50A of the regulation member 5. Further, the second transmission gear 64 is disposed on the side wall 100B so as to face the first transmission gear 63 in the mounting direction (front-rear direction) of the cassette 110. Accordingly, upon the cassette 110 being mounted to the main body housing 10, the second transmission gear 64 engages with the first transmission gear 63 of the transmission member 6A.

<Operation of Sheet Feed Portion 20>

Figure 8:
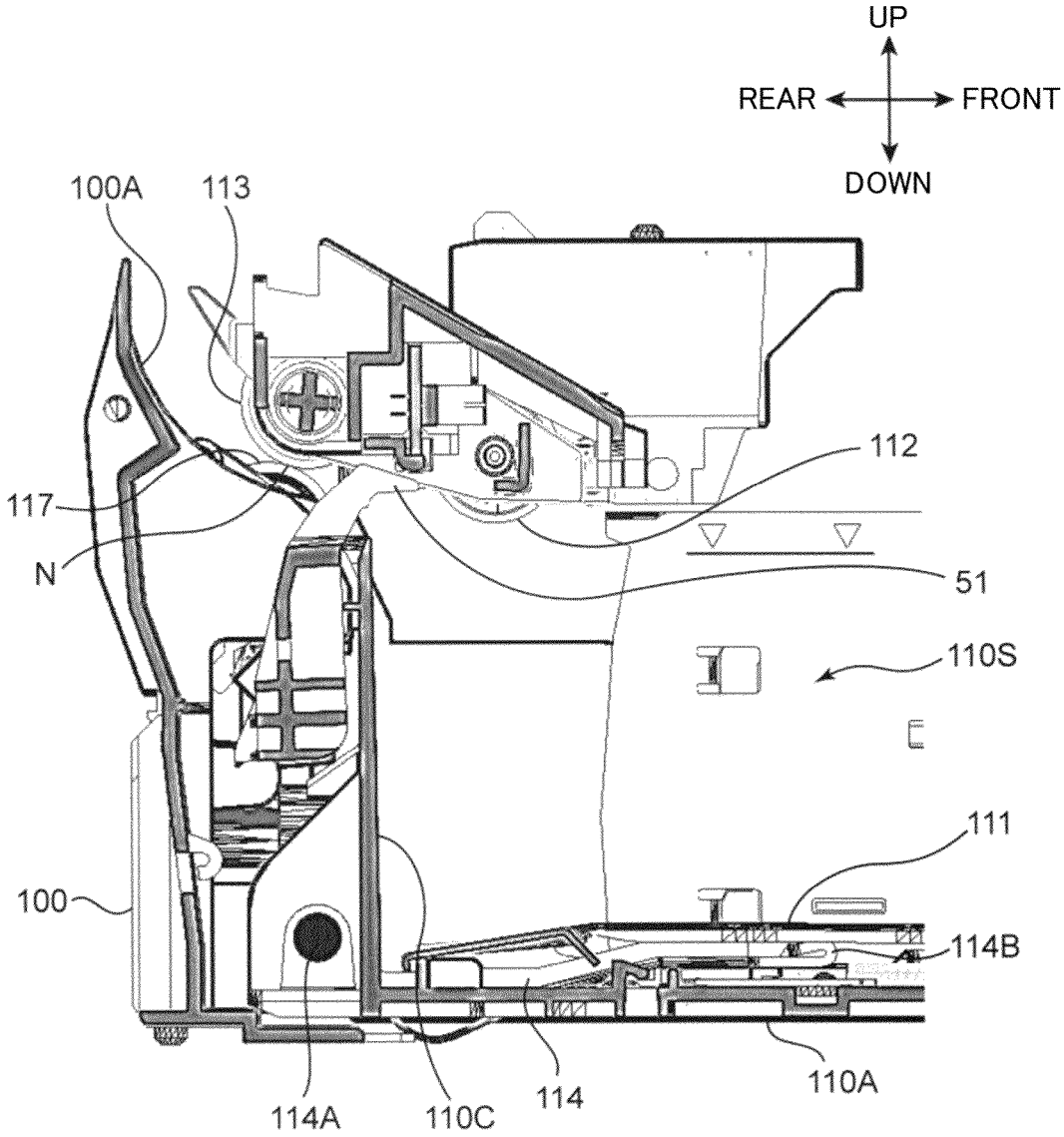
FIG. 8 is a cross-sectional view showing a part of the apparatus body of the image forming apparatus and a part of the cassette in the state shown in FIG. 7.
Figure 9:
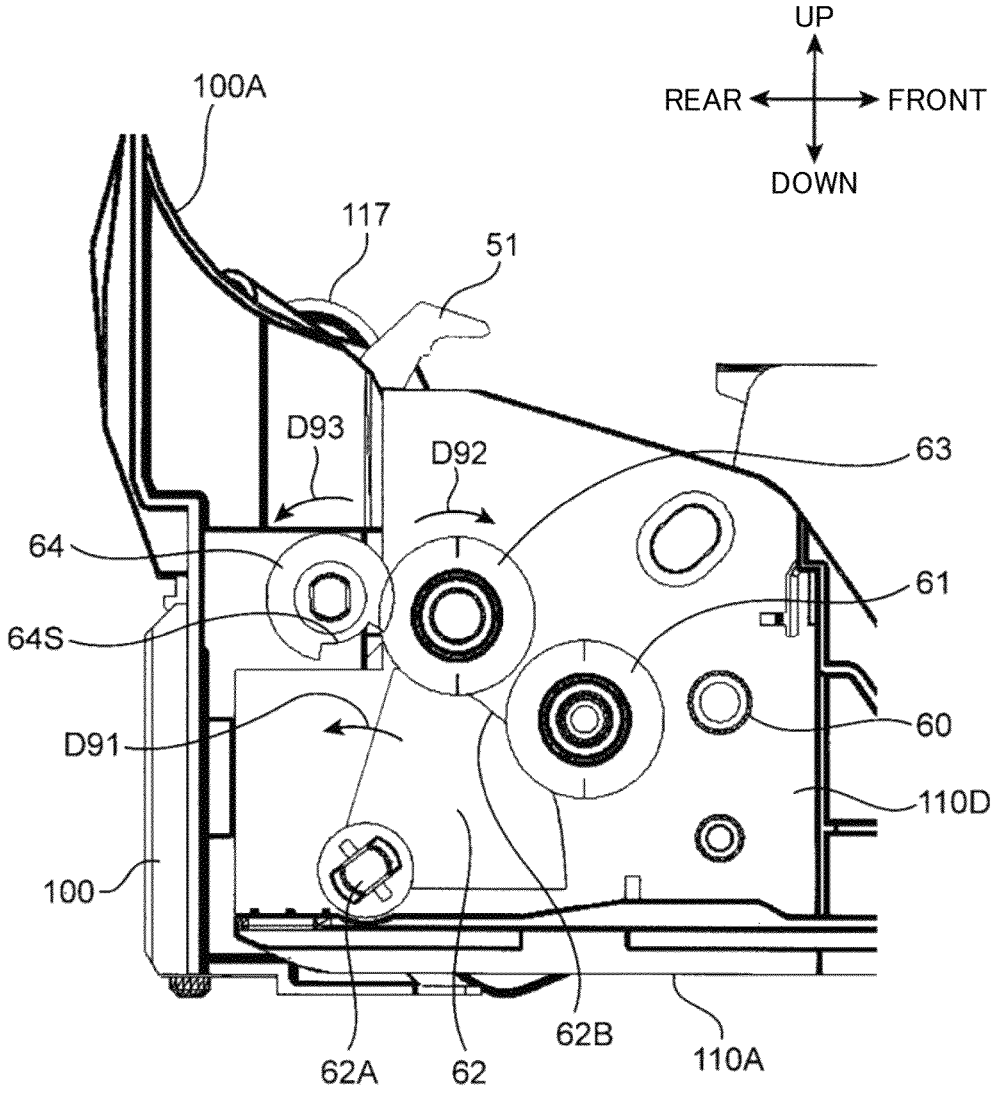
FIG. 9 is a side view showing a part of the apparatus body of the image forming apparatus and a part of the cassette in the state shown in FIG. 7.
Figure 10:
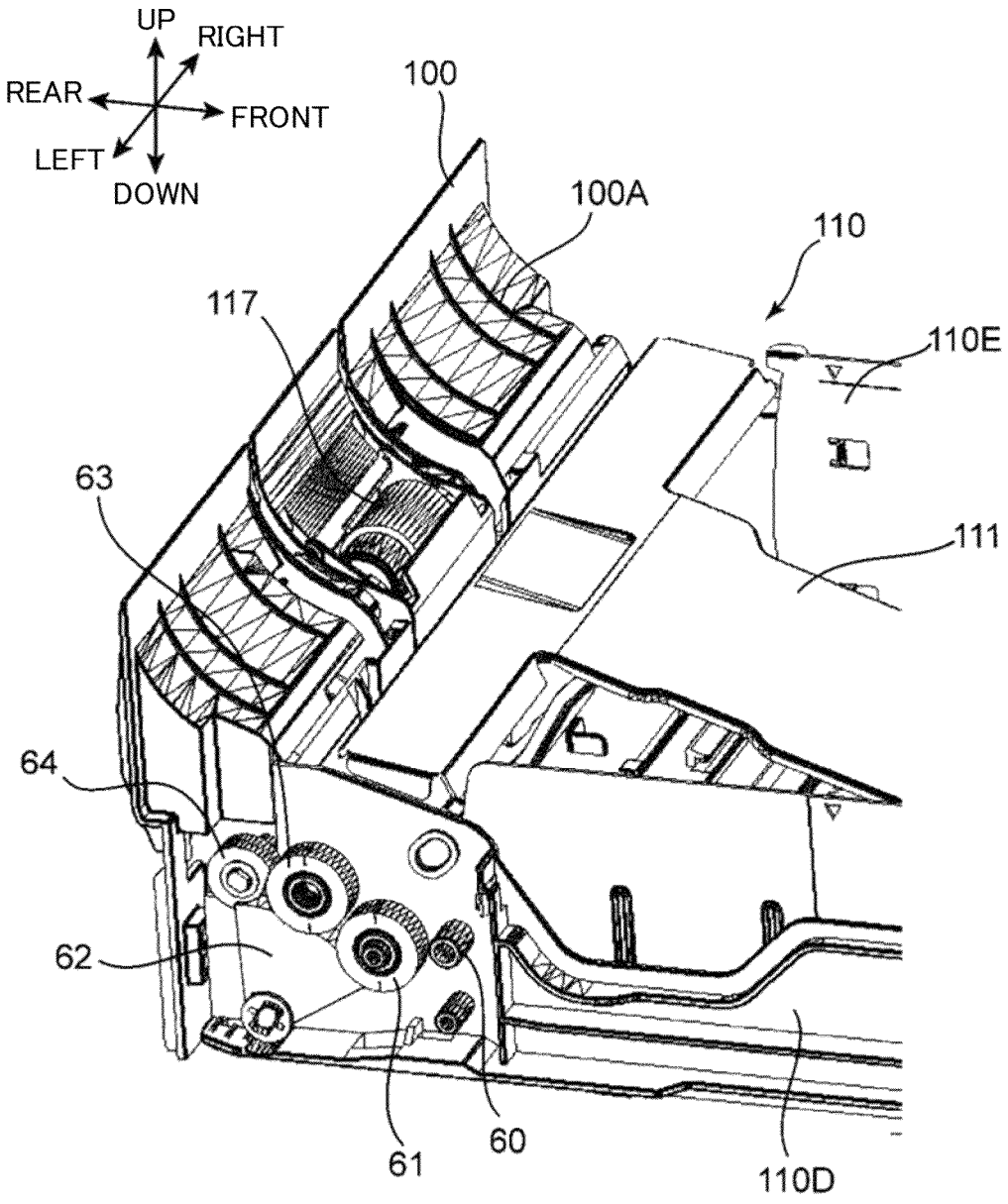
FIG. 10 is a perspective view showing a part of the apparatus body of the image forming apparatus and a part of the cassette in a state where the lift plate is lifted.
Figure 11:
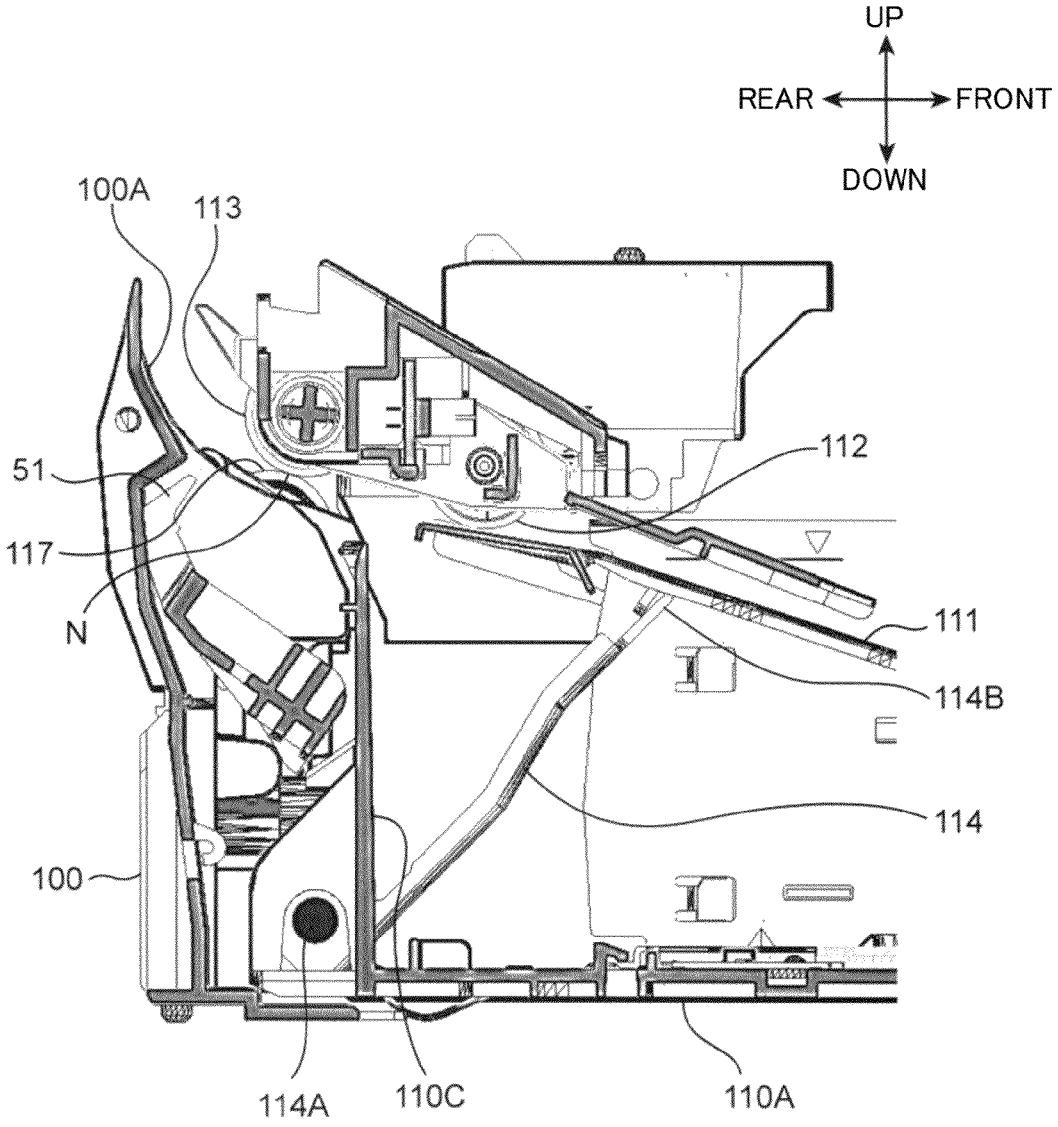
FIG. 11 is a cross-sectional view showing a part of the apparatus body of the image forming apparatus and a part of the cassette in the state shown in FIG. 10.
Figure 12:
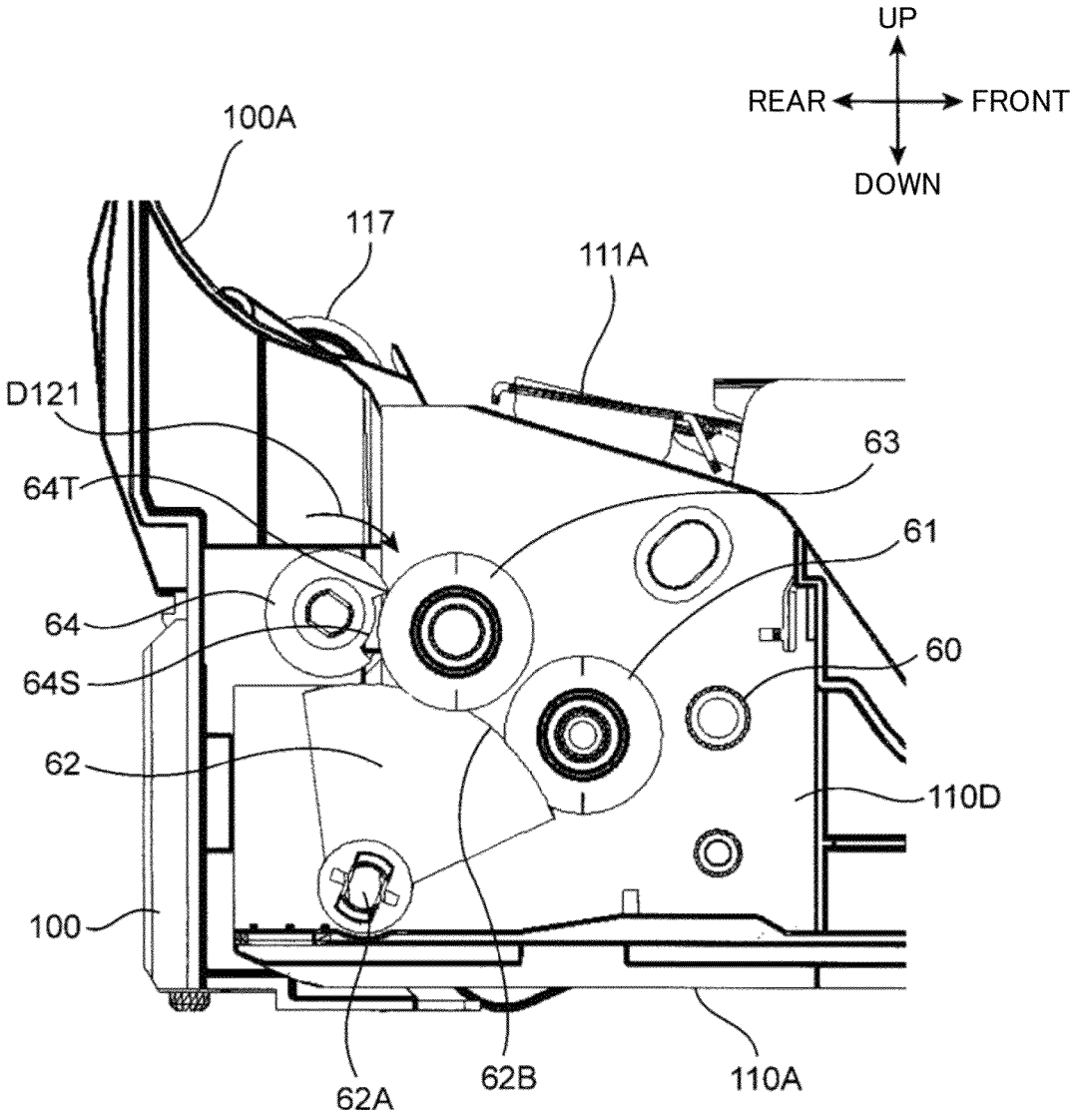
FIG. 12 is a side view showing a part of the apparatus body of the image forming apparatus and a part of the cassette in the state shown in FIG. 10.

Next, operation of the sheet feed portion 20 according to the present embodiment will be described. FIG. 7 is a perspective view showing the guide wall portion 100 and a part of the cassette 110 in a state where the lift plate 111 is in the first position. Further, FIG. 8 is a cross-sectional view of the guide wall portion 100 and the part of the cassette 110 shown in FIG. 7. Still further, FIG. 9 is a side view of the guide wall portion 100 and the part of the cassette 110 shown in FIG. 7. Meanwhile, FIG. 10 is a perspective view of the guide wall portion 100 and a part of the cassette 110 in a state where the lift plate 111 is in the second position. Further, FIG. 11 is a cross-sectional view of the guide wall portion 100 and the part of the cassette 110 shown in FIG. 10. Still further, FIG. 12 is a side view of the guide wall portion 100 and the part of the cassette 110 shown in FIG. 10.

With reference to FIGS. 1 and 4, a case will be supposed where a user draws the cassette 110 out from the main body housing 10, and places sheets S onto the sheet storage portion 110S of the cassette 110. In this case, as shown in FIG. 7, the lift plate 111 is disposed in the lower position (first position) near the cassette bottom wall 110A of the cassette 110.

When the cassette 110 is removed from the main body housing 10, the transmission member 6A is not connected to the second transmission gear 64. In other words, driving force of the drive motor 70 is not transmitted to the second transmission gear 64. Further, the regulation pieces 51 of the regulation member 5 (see FIG. 4) protrude, relative to the fed-sheet nip portion N (retard roller 117), to the upstream (front side) in the sheet conveying direction of the main conveying path 22F. As shown in FIG. 4, the leading end of each regulation piece 51 is bent forwardly.

Upon placing sheets S onto the sheet storage portion 110S of the cassette 110, the user inserts the cassette 110 into the main body housing 10. In particular, when the sheet storage portion 110S is almost fully filled with the sheets S, insertion force of the cassette 110 is applied to the sheets S in the sheet storage portion 110S as described above, and consequently the top several sheets S become likely to enter the fed-sheet nip portion N at a time. However, in the present embodiment, since the regulation pieces 51 protrude to the main conveying path 22F before the cassette 110 is inserted into the main body housing 10 as described above, entering of the sheets S into the fed-sheet nip portion N is preferably prevented. With this structure, entering of the sheets S into the fed-sheet nip portion N is assuredly prevented, as compared to a case where the regulation member protrudes to the main conveying path 22F in conjunction with insertion of the cassette 110 into the main body housing 10. As a result, multi-feed into the sheet conveying path is prevented, and thereby image forming on each sheet can be performed stably.

When the cassette 110 is mounted into the main body housing 10 such that the cassette rear wall 110C of the cassette 110 faces the facing wall 100C of the guide wall portion 100, the state shown in FIGS. 7 to 9 is attained. In this state, the first transmission gear 63 of the transmission member 6A engages with the second transmission gear 64 in the guide wall portion 100. Further, the main-body-side input gear connected to the drive motor 70 engages with the input gear 61 of the cassette 110.

To execute a print operation on the image forming apparatus 1, a control portion (not shown) gives an instruction to lift the lift plate 111. The control portion causes the drive motor 70 to drive to rotate, and the rotational driving force of the drive motor 70 is transmitted to the sector gear 62 via the input gear 61. Consequently, the sector gear 62 rotates in a direction indicated with an arrow D91 in FIG. 9. Accordingly, the lifting shaft 114A of the lifting portion 114 connected to the sector gear axis portion 62A of the sector gear 62 rotates in a direction indicated with an arrow D51 in FIG. 5, and thereby the lifting portion 114 lifts the lift plate 111 upward. Thus, the lift plate 111 moves from the first position to the second position.

In conjunction with the movement of the lift plate 111, the sector gear 62 causes the first transmission gear 63 to rotate in a direction indicated with an arrow D92 in FIG. 9. Further, the first transmission gear 63 causes the second transmission gear 64 to rotate in a direction indicated with an arrow D93 in FIG. 9. As a result, the shaft 50A connected to the second transmission gear 64 rotates in a direction indicated with an arrow D62 in FIG. 6, and thereby the regulation pieces 51 retreat from the main conveying path 22F (see FIGS. 10 and 11). That is, when the lift plate 111 is positioned in the second position, and the sheets S become ready to be conveyed by the pickup roller 112, the main conveying path 22F between the pickup roller 112 and fed-sheet nip portion N becomes open (see FIG. 11).

As described above, according to the present embodiment, when the cassette 110 is mounted to the main body housing 10, the driving force of the drive motor 70 is transmitted to the lift plate 111 and the regulation member 5. Consequently, the transmission member 6A causes the lifting portion 114 to rotate about the lifting shaft 114A, thereby enabling the lift plate 111 to move up and down. Further, with a connection between the transmission member 6A and the second transmission gear 64, rotation of the regulation pieces 51 about the support portion 50 is attained. Accordingly, the rotation of the regulation pieces 51 allows the main conveying path 22F to be closed or opened.

It should be noted that, in the present embodiment, as shown in FIG. 12, the second transmission gear 64 has a cut portion 64S. When a large number of sheets S is placed in the sheet storage portion 110S of the cassette 110, the lift plate 111 will not be lifted up to the highest position shown in FIGS. 10 to 12. In other words, since the top sheet face of the sheets S accumulated on the lift plate 111 comes in contact with the pickup roller 112, the movement of the lift plate 111 stops. The cut portion 64S is arranged so that the regulation member 5 can be retreated from the main conveying path 22F even with a slight upward movement of the lift plate 111 like this case.

That is, the gear ratio among the sector gear 62, the first transmission gear 63, and the second transmission gear 64 is previously set such that the regulation pieces 51 retreat from the main conveying path 22F soon after the cassette 110 is mounted into the main body housing 10 and the sector gear 62 starts rotating in the direction indicated with the arrow D91 in FIG. 9. Upon the regulation pieces 51 retreating from the main conveying path 22F, the cut portion 64S of the second transmission gear 64 is positioned to face the first transmission gear 63. Accordingly, even if the sector gear 62 rotates thereafter, the rotational driving force will not be transmitted from the first transmission gear 63 to the second transmission gear 64. In other words, when the lift plate 111 is moved up to the highest position as shown in FIG. 12, the second transmission gear 64 is idled, whereby rotation of the regulation member 5 stops, and transmission of excessive driving force to the regulation member 5 is prevented.

It should be noted that even in the case where the cut portion 64S faces the first transmission gear 63, a gear tooth 64T which defines one end of the cut portion 64S is positioned so as to engage with a gear tooth of the first transmission gear 63. In particular, in the present embodiment, with the urging force applied to the shaft 50A by the spring member 50B, the second transmission gear 64 is urged toward a direction indicated with an arrow D121 in FIG. 12. As a result, even when the control portion (not shown) causes the drive motor 70 to rotate reversely and causes the lift plate 111 to be lifted down, the first transmission gear 63 and the second transmission gear 64 can engage with each other in a stable manner.

In the state shown in FIGS. 10 to 12, when a user removes the cassette 110 from the main body housing 10, connection between the second transmission gear 64 and the first transmission gear 63 is released. Concurrently, connection between the transmission member 6A and the drive motor 70 is also released. In this case, the lift plate 111 moves from the second position to the first position due to its own weight. Meanwhile, the regulation member 5 again protrudes to the main conveying path 22F due to the urging force by the spring member 50B. As a result, even if the cassette 110 is removed from the main body housing 10 inadvertently, the regulation pieces 51 can be caused to protrude to the main conveying path 22F assuredly. Accordingly, it is possible to preferably prevent the sheets S in the cassette 110, when the cassette 110 is to be mounted again, from entering the fed-sheet nip portion N. According to this structure, even when the cassette 110 is removed from the main body housing 10, the lift plate 111 can be moved to the first position using a simple mechanism. Further, since the connection between the transmission member 6A and the drive motor 70 is released, the movement of the lift plate 111 caused by its own weight will not be hampered. Under the state where the cassette 110 is removed from the main body housing 10, due to the urging force of the spring member 50B, a region of the second transmission gear 64 that faces the first transmission gear 63 is fixed, as indicated in FIG. 9. Accordingly, when the cassette 110 is again mounted to the main body housing 10, the first transmission gear 63 engages with the second transmission gear 64 in a stable manner.

The sheet feed portion 20 and image forming apparatus 1 including the sheet feed portion 20 according to an embodiment of the present disclosure have been described above. However, the present disclosure is not limited to this, but any modified embodiments as described below can be implemented.

The above embodiment describes a structure in which the regulation member 5 is urged by the spring member 50B toward the direction in which the regulation member 5 protrudes to the main conveying path 22F. However, the present disclosure is not limited to this. For example, a structure may be applicable in which the regulation pieces 51 protrude to the main conveying path 22F due to the weight of the regulation member 5 when the cassette 110 is removed from the main body housing 10.

In the above-described embodiment, the retard roller 117 is used as a member opposing the sheet feed roller 113. However, the present disclosure is not limited to this. As the opposing member, a sheet feed pad having a face opposing the sheet feed roller 113 may be used.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feed device comprising:

an apparatus body;

a cassette configured to be detachably mounted to the apparatus body along a sheet conveying direction, the cassette having a sheet storage portion that stores therein sheets;

a sheet conveying path extending from the sheet storage portion toward the apparatus body, the sheet conveying path being configured to convey each of the sheets;

a pickup roller disposed on an inlet side of the sheet conveying path in such a manner as to oppose the sheet storage portion, the pickup roller being configured to come in contact with the sheet stored in the sheet storage portion to thereby feed the sheet;

a feeding portion including a sheet feed roller disposed on a downstream side in the sheet conveying direction relative to the pickup roller, and a separation roller that is in contact with the sheet feed roller to thereby form a nip portion, the feeding portion being configured to convey the sheet fed from the pickup roller downstream in the sheet conveying direction while holding the sheet at the nip portion;

a lift plate disposed in the sheet storage portion so as to allow the sheets to be placed thereon, the lift plate being changeable in position between a first position which is along a bottom portion of the cassette and a second position which is upper than the first position and at which an end of the sheet stored in the sheet storage portion, the end being on the downstream side in the sheet conveying direction, is caused to come in contact with the pickup roller; and a regulation member disposed in the apparatus body, the regulation member being configured, when the cassette is removed from the apparatus body and the lift plate is positioned in the first position, to protrude to the sheet conveying path on an upstream side in the sheet conveying direction relative to the fed-sheet nip portion to thereby regulates entering of the sheets stored in the sheet storage portion into the fed-sheet nip portion, and configured, when the cassette is mounted into the apparatus body and the lift plate is positioned in the second position, to retreat from the sheet conveying path thereby to cause the sheet conveying path to become open.

2. The sheet feed device according to claim 1 further comprising:

a driving portion configured to generate a driving force which causes the lift plate to move between the first position and the second position; and a transmission mechanism configured to cause the regulation member to protrude to or retreat from the sheet conveying path in conjunction with the movement of the lift plate caused by the driving portion.

3. The sheet feed device according to claim 2, wherein the driving portion is disposed in the apparatus body, at least a part of the transmission mechanism is disposed on the cassette, and when the cassette is mounted into the apparatus body, the driving force of the driving portion can be transmitted to the lift plate and the regulation member.

4. The sheet feed device according to claim 3, wherein the regulation member includes:

an axis portion extending, in the apparatus body, in a sheet width direction which intersects the sheet conveying direction; and a regulation piece protruding from the axis portion outwardly in a radial direction of the axis portion, the regulation piece being configured to rotate about the axis portion with the axis portion to thereby protrude to or retreat from the sheet conveying path.

5. The sheet feed device according to claim 4 further comprising an urging member which urges the axis portion, along an circumferential direction of the axis portion, toward a direction in which the regulation piece protrudes to the sheet conveying path.

6. The sheet feed device according to claim 4, further comprising:

a lifting member disposed between the bottom portion of the cassette and the lift plate, the lifting member having a supporting shaft and being rotatable about the supporting shaft to cause the lift plate to move up and down, wherein the transmission mechanism includes:

a transmission member disposed on the cassette, the transmission member being connected to the driving portion so as to cause the lifting member to rotate about the supporting shaft; and a gear portion disposed at one end of the axis portion of the regulation member, the gear portion engaging with the transmission member in conjunction with mounting of the cassette into the apparatus body.

7. The sheet feed device according to claim 6, wherein the cassette includes:

a leading end wall that stands on an leading end side in a mounting direction into which the cassette is mounted to the apparatus body; and side walls disposed along the mounting direction in such a manner as to intersect the leading end wall, the apparatus body includes:

a facing wall with side surface disposed to face the leading end wall of the cassette, the transmission member is disposed on the leading end side, in the mounting direction, of one of the side walls of the cassette, the axis portion of the regulation member extends along the facing wall, and the gear portion is disposed on one of the side surface in such a manner as to face the transmission member in the mounting direction.

8. The sheet feed device according to claim 6, wherein when the cassette is removed from the apparatus body and the connecting of the transmission member to the driving portion is released, the lift plate is caused to move from the second position to the first position due to its own weight.

9. An image forming apparatus comprising:

the sheet feed device according to claim 1; and an image forming portion configured to form an image on a sheet conveyed by the sheet feed device.

10. The image forming apparatus according to claim 9, further comprising:

a driving portion configured to generate a driving force which causes the lift plate to move between the first position and the second position; and a transmission mechanism configured to cause the regulation member to protrude to or retreat from the sheet conveying path in conjunction with the movement of the lift plate caused by the driving portion.

11. The image forming apparatus according to claim 10, wherein the driving portion is disposed in the apparatus body, at least a part of the transmission mechanism is disposed on the cassette, and when the cassette is mounted into the apparatus body, the driving force of the driving portion can be transmitted to the lift plate and the regulation member.

12. The image forming apparatus according to claim 11, wherein the regulation member includes:

an axis portion extending, in the apparatus body, in a sheet width direction which intersects the sheet conveying direction; and a regulation piece protruding from the axis portion outwardly in a radial direction of the axis portion, the regulation piece being configured to rotate about the axis portion with the axis portion to thereby protrude to or retreat from the sheet conveying path.

13. The image forming apparatus according to claim 12 further comprising an urging member which urges the axis portion, along an circumferential direction of the axis portion, toward a direction in which the regulation piece protrudes to the sheet conveying path.

14. The image forming apparatus according to claim 12, further comprising:

a lifting member disposed between the bottom portion of the cassette and the lift plate, the lifting member having a supporting shaft and being rotatable about the supporting shaft to cause the lift plate to move up and down, wherein the transmission mechanism includes:

a transmission member disposed on the cassette, the transmission member being connected to the driving portion so as to cause the lifting member to rotate about the supporting shaft; and a gear portion disposed at one end of the axis portion of the regulation member, the gear portion engaging with the transmission member in conjunction with mounting of the cassette into the apparatus body.

15. The image forming apparatus according to claim 14, wherein the cassette includes:

a leading end wall that stands on an leading end side in a mounting direction into which the cassette is mounted to the apparatus body; and side walls disposed along the mounting direction in such a manner as to intersect the leading end wall, the apparatus body includes:

a facing wall with side surface disposed to face the leading end wall of the cassette, the transmission member is disposed on the leading end side, in the mounting direction, of one of the side walls of the cassette, the axis portion of the regulation member extends along the facing wall, and the gear portion is disposed on one of the side surface in such a manner as to face the transmission member in the mounting direction.

16. The image forming apparatus according to claim 14, wherein when the cassette is removed from the apparatus body and the connecting of the transmission member to the driving portion is released, the lift plate is caused to move from the second position to the first position due to its own weight.

* * * * *